US010028635B2

(12) United States Patent
Vanderroest

(10) Patent No.: US 10,028,635 B2
(45) Date of Patent: Jul. 24, 2018

(54) METHODS FOR DISPENSING A TREATING CHEMISTRY IN A DISHWASHER

(71) Applicant: Whirlpool Corporation, Benton Harbor, MI (US)

(72) Inventor: Chad T. Vanderroest, Covert, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 609 days.

(21) Appl. No.: 13/869,104

(22) Filed: Apr. 24, 2013

(65) Prior Publication Data

US 2014/0318579 A1 Oct. 30, 2014

(51) Int. Cl.

| | |
|---|---|
| ***B08B 7/04*** | (2006.01) |
| ***A47L 15/00*** | (2006.01) |
| *B08B 9/20* | (2006.01) |
| *B08B 3/02* | (2006.01) |
| *B08B 3/04* | (2006.01) |
| *B08B 3/00* | (2006.01) |

(52) U.S. Cl.

CPC ..... *A47L 15/0055* (2013.01); *A47L 2401/12* (2013.01); *A47L 2501/01* (2013.01); *A47L 2501/02* (2013.01); *A47L 2501/05* (2013.01); *A47L 2501/06* (2013.01); *A47L 2501/07* (2013.01); *B08B 3/00* (2013.01); *B08B 3/02* (2013.01); *B08B 3/04* (2013.01); *B08B 7/04* (2013.01); *B08B 9/20* (2013.01)

(58) Field of Classification Search

CPC .... A47L 15/4287; A47L 15/44–15/449; A47L 2401/12; A47L 2501/07; B08B 3/00; B08B 3/02; B08B 3/04; B08B 7/04; B08B 9/20

See application file for complete search history.

(56) References Cited

U.S. PATENT DOCUMENTS

| | | | | |
|---|---|---|---|---|
| 5,133,487 | A | 7/1992 | Russi | |
| 7,445,013 | B2 | 11/2008 | Vanderroest et al. | |
| 7,523,758 | B2 | 4/2009 | Vanderroest et al. | |
| 2006/0076038 | A1* | 4/2006 | Hering et al. | 134/18 |
| 2007/0151578 | A1* | 7/2007 | Cho et al. | 134/18 |
| 2007/0246069 | A1 | 10/2007 | Elick et al. | |
| 2009/0056760 | A1 | 3/2009 | Kessler et al. | |
| 2010/0139699 | A1* | 6/2010 | Dalton et al. | 134/25.2 |
| 2011/0000511 | A1 | 1/2011 | Mersch et al. | |
| 2011/0132411 | A1 | 6/2011 | Kessler et al. | |

(Continued)

FOREIGN PATENT DOCUMENTS

| | | | |
|---|---|---|---|
| DE | 19954706 | A1 | 5/2001 |
| DE | 19957243 | A1 | 5/2001 |

(Continued)

*Primary Examiner* — Sharidan Carrillo

(74) *Attorney, Agent, or Firm* — McGarry Bair PC

(57) ABSTRACT

A dishwasher has a treating chamber for receiving dishes for treatment according to an automatic cycle of operation and a dispensing system for storing and dispensing a treating chemistry to the treating chamber during the cycle of operation. The dishwasher may dispense a treating chemistry when a temperature of a liquid in the treating chamber satisfies a predetermined temperature threshold. The temperature of the liquid may be maintained to satisfy the predetermined temperature threshold for a predetermined period of time based on the treating chemistry.

14 Claims, 6 Drawing Sheets

(56) References Cited

U.S. PATENT DOCUMENTS

| | | | | |
|---|---|---|---|---|
| 2011/0180118 | A1 | 7/2011 | Schrott | |
| 2011/0214702 | A1 | 9/2011 | Brown-West et al. | |
| 2012/0031930 | A1 | 2/2012 | Fileccia et al. | |
| 2012/0090638 | A1 | 4/2012 | Kessler et al. | |
| 2013/0112225 | A1* | 5/2013 | Im et al. | 134/18 |

FOREIGN PATENT DOCUMENTS

| | | | |
|---|---|---|---|
| DE | 102011001869 | * | 11/2012 |
| EP | 2012645 | A1 | 1/2009 |
| EP | 2131717 | A1 | 12/2009 |
| EP | 2449943 | A2 | 5/2012 |
| WO | 2008080799 | A1 | 7/2008 |
| WO | 2009033828 | A1 | 3/2009 |
| WO | 2011110242 | A1 | 9/2011 |
| WO | 2011110246 | A1 | 9/2011 |
| WO | 2012126536 | A1 | 9/2012 |

* cited by examiner

METHODS FOR DISPENSING A TREATING CHEMISTRY IN A DISHWASHER

BACKGROUND

Contemporary automatic dishwashers for use in a home typically include a dispenser for automatically dispensing one or more treating chemistries to dishes in a treating chamber of the dishwasher at a predetermined time during a cycle of operation. For example, during a cycle of operation having a wash phase and a rinse phase, a wash aid is supplied to the treating chamber at a predetermined time during the wash phase and an optional rinse aid can be supplied to the treating chamber at a predetermined time during the rinse phase.

BRIEF DESCRIPTION

The invention relates to dispensing a treating chemistry to a treating chamber of a dishwasher during a cycle of operation when a temperature of a liquid in the treating chamber satisfies a predetermined temperature threshold and maintaining the temperature of the liquid to satisfy the predetermined temperature threshold for a predetermined period of time based on the treating chemistry.

DESCRIPTION OF EMBODIMENTS OF THE INVENTION

Figure 1:
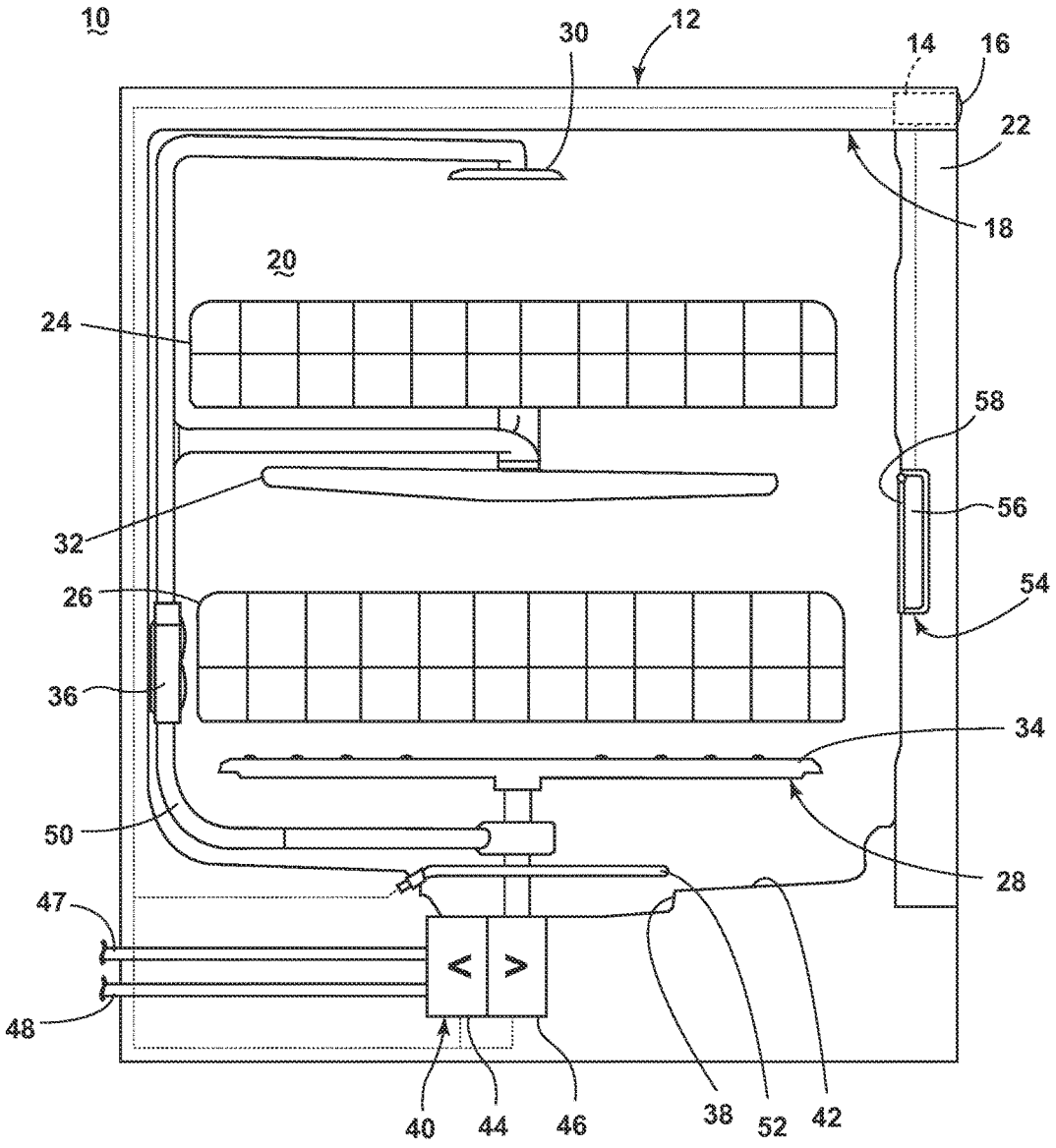
FIG. 1 is a schematic, side view of a dishwasher according to an embodiment of the invention.

FIG. 1 is a schematic, side view of a dishwasher 10 according to one embodiment of the invention. In FIG. 1, the dishwasher 10 includes a chassis 12 defining an interior. Depending on whether the dishwasher 10 is a stand-alone or built-in dishwasher, the chassis 12 may be a frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the chassis 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the interior of the chassis 12 and at least partially defines a treating chamber 20 with an access opening in the form of an open face. A cover, illustrated as a door 22, may be hingedly mounted to the chassis 12 and may selectively move between an opened position, wherein the user may access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; dishes, plates, pots, bowls, pans, glassware, silverware, and other utensils. While not shown, additional dish holders, such as a silverware basket on the interior of the door 22 or a third level rack above the upper rack 24 may also be provided.

A spraying system 28 may be provided for spraying liquid into the treating chamber 20 and is illustrated in the form of an upper sprayer 30, a mid-level sprayer 32, a lower sprayer 34, and a spray manifold 36. The upper sprayer 30 may be located above the upper rack 24 and is illustrated as a fixed spray nozzle that sprays liquid downwardly within the treating chamber 20. Mid-level sprayer 32 and lower sprayer 34 are located beneath upper rack 24 and lower rack 26, respectively, and are illustrated as rotating spray arms. The mid-level sprayer 32 may provide a liquid spray upwardly through the bottom of the upper rack 24. The lower sprayer 34 may provide a liquid spray upwardly through the bottom of the lower rack 26. The mid-level sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in any suitable part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recess portion of a bottom wall 42 of the tub 18. The pump assembly 40 may include both a drain pump 44 and a recirculation pump 46. The liquid recirculation system may also be fluidly coupled with a water supply line 47 for receiving fresh water from a water supply source, such as a household water supply.

The drain pump 44 may draw liquid from the sump 38 and pump the liquid out of the dishwasher 10 to a household drain line 48. The recirculation pump 46 may draw liquid from the sump 38 and pump the liquid through the spray system 28 to supply liquid into the treating chamber 20 through a supply tube 50 to one or more of the sprayers 30, 32, 34, 36. In this manner, liquid may circulate from the sump 38 through the liquid recirculation system to the spray system 28 and back to the sump 38 to define a liquid recirculation circuit or flow path.

While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system.

A heating system having a heater 52 may be located within or near the sump 38 for heating liquid contained in the sump 38. A filtering system (not shown) may be fluidly coupled with the recirculation flow path for filtering the recirculated liquid.

A user-accessible dispensing system may be provided for storing and dispensing one or more treating chemistries to the treating chamber 20. As shown herein, the user-accessible dispensing system may include a dispenser 54 mounted on an inside surface of the door 22 such that the dispenser 54 is disposed in the treating chamber 20 when the door 22 is in the closed position. The dispenser 54 is configured to dispense treating chemistry to the dishes within the treating chamber 20. The dispenser 54 may have one or more compartments 56 closed by a door 58 on the inner surface of the door 22. The dispenser 54 may be a single use dispenser which holds a single dose of treating chemistry, a bulk dispenser which holds a bulk supply of treating chemistry and which is adapted to dispense a dose of treating chemistry from the bulk supply during a cycle of operation, or a combination of both a single use and bulk dispenser.

The dispenser 54 may further be configured to hold multiple different treating chemistries. For example, the dispenser 54 may have multiple compartments defining different chambers in which treating chemistries may be held. While shown as being disposed on the door 22, other locations of the dispenser 54 are possible. However, the dispenser 54 is positioned to be accessed by the user for refilling of the dispenser 54, whether it is necessary to refill the dispenser 54 before each cycle (i.e. for a single user dispenser) or only periodically (i.e. for a bulk dispenser).

Figure 2:
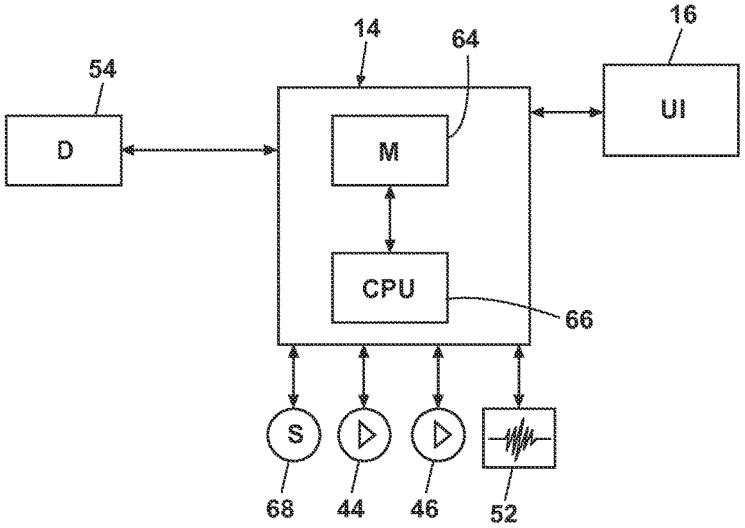
FIG. 2 is a schematic view of a controller of the dishwasher of FIG. 1.

FIG. 2 is a schematic view of the controller 14 of the dishwasher 10 of FIG. 1. As illustrated schematically in FIG. 2, the controller 14 may be coupled with the heater 52 for heating the wash liquid during a cycle of operation, the drain pump 44 for draining liquid from the treating chamber 20, the recirculation pump 46 for recirculating the wash liquid during the cycle of operation, the user-accessible dispenser 54 for selectively dispensing treating chemistry to the treating chamber 20, and the user-inaccessible dispensing system 60 for selectively dispensing rinse aid to the treating chamber 20.

The controller 14 may be provided with a memory 64 and a central processing unit (CPU) 66. The memory 64 may be used for storing control software that may be executed by the CPU 66 in completing a cycle of operation using the dishwasher 10 and any additional software. For example, the memory 64 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 14 may also receive input from one or more sensors 68. Non-limiting examples of sensors 68 that may be communicably coupled with the controller 14 include a temperature sensor and turbidity sensor to determine the soil load associated with a selected grouping of dishes, such as the dishes associated with a particular area of the treating chamber 20.

Figure 3:
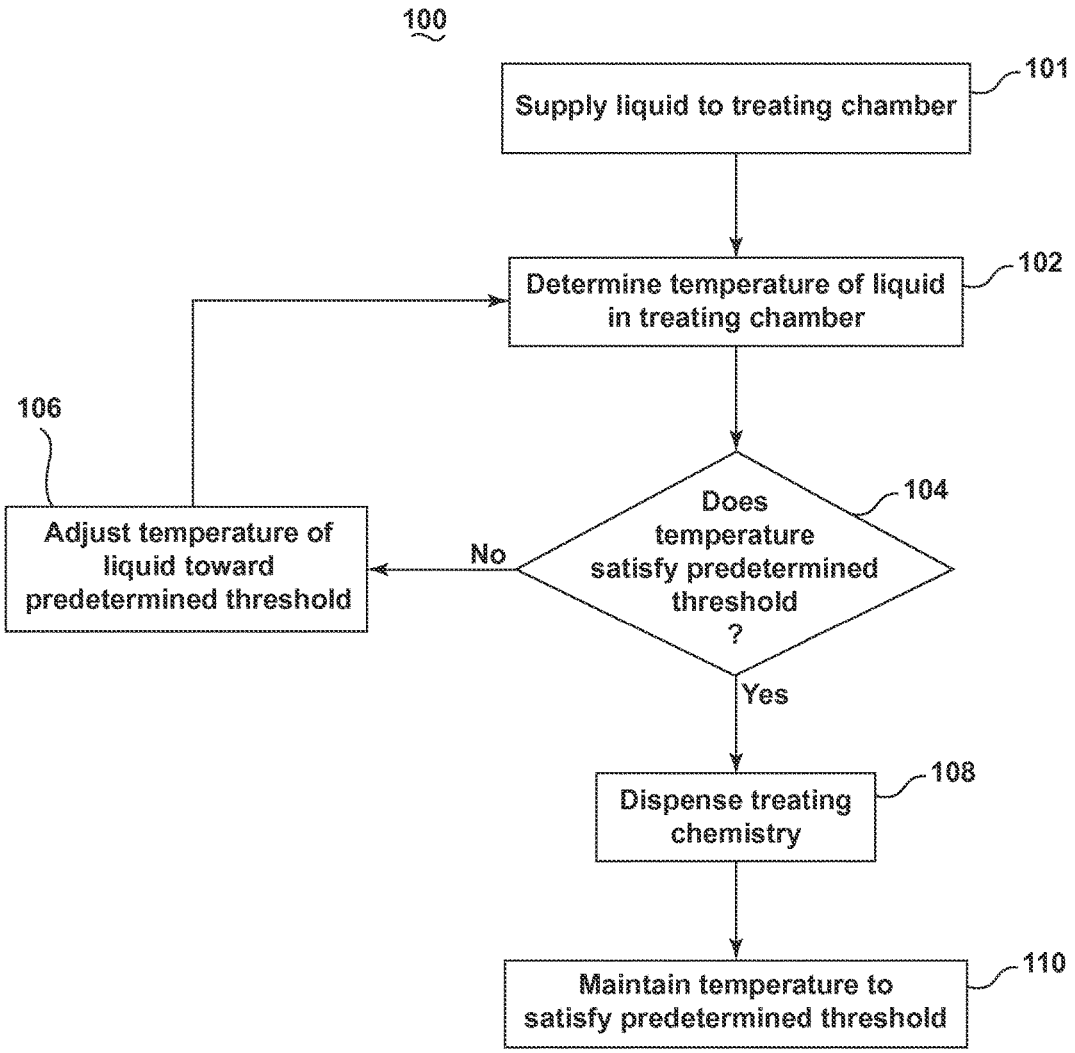
FIG. 3 is a flow chart illustrating a method of dispensing a treating chemistry during a cycle of operation according to an embodiment of the invention.

Referring now to FIG. 3, a method 100 of operating the dishwasher 10 based on a temperature-sensitive characteristic of a treating chemistry to be supplied to the treating chamber 20 during a cycle of operation is illustrated. As used herein, the term temperature-sensitive characteristic refers to a characteristic of the treating chemistry which varies based on temperature. Non-limiting examples of temperature-sensitive characteristics include reactivity, solubility, or foam-formation of the treating chemistry. As used herein, the term treating chemistry may refer to an individual substance or a combination of substances, one or more of which may have a temperature-sensitive characteristic, non-limiting examples of which include surfactants, enzymes, bleaches, oxidizing agents, ozone, pH modifiers, builders, dyes, fragrances, etc. The sequence of steps depicted for this method and the subsequent methods are for illustrative purposes only, and are not meant to limit any of the methods in any way as it is understood that the steps may proceed in a different logical order or additional or intervening steps may be included without detracting from the invention.

The method 100 begins with assuming that a user has loaded the dishwasher 10 with dishes to be treated, selected a desired cycle of operation which includes dispensing at least one temperature-sensitive treating chemistry during at least one phase of the selected cycle of operation, and provided the dispenser 54 with the at least one temperature-sensitive treating chemistry. At a predetermined period of time following initiation of the selected cycle of operation, liquid may be supplied to the treating chamber 20 at 101. Supplying liquid to the treating chamber 20 may include supplying fresh water from a water supply source through the water supply line 47 to the sump 38 and optionally circulating the water through the recirculation circuit.

Following initiation of the selected cycle of operation, such as after a predetermined period of time, a temperature of the liquid within the treating chamber 20 may be determined at 102. The dishwasher 10 may include one or more temperature sensors, configured to output a signal indicative of the temperature of the liquid within the treating chamber 20. Non-limiting examples of suitable temperature sensors include a thermistor or thermocouple. One or more temperature sensors may be provided in the sump 38 to sense the temperature of the liquid supplied to the treating chamber 20 that has collected in the sump 38. Alternatively, or additionally, one or more temperature sensors may be provided in any other location along the recirculation circuit, such as within the supply tube 50, to sense the temperature of the liquid supplied to the treating chamber 20 that is circulating through the recirculation circuit.

Determining the temperature of the liquid at 102 may be done continuously or intermittently throughout the entire cycle of operation or a phase of the cycle of operation or only during a portion of the cycle of operation or a phase of the cycle of operation. In one example, the temperature of liquid may be determined at predetermined intervals following the supply of liquid to the treating chamber at 101. In another example, the temperature of the liquid may be determined continuously or intermittently starting at a predetermined point in a phase of the cycle of operation in which a treating chemistry is to be dispensed according to the method 100. The predetermined point may correspond to a point in the phase at which it is desired to dispense the treating chemistry or may correspond to a point in the phase a predetermined period of time prior to the point at which it is desired to dispense the treating chemistry.

At 104, the temperature of the treating liquid determined at 102 may be compared with a predetermined temperature threshold to see if the temperature of the treating liquid satisfies the threshold. This may include comparing the temperature sensor output to a predetermined reference value that may be a range of reference values, an upper threshold or a lower threshold. The term "satisfies" the threshold is used herein to mean that the variation satisfies the predetermined threshold, such as being equal to, less than, or greater than the threshold value, as the relationship may be established. It will be understood that such a determination may easily be altered to be satisfied by a positive/negative comparison or a true/false comparison. For example, a less than threshold value can easily be satisfied by applying a greater than test when the data is numerically inverted.

The predetermined temperature threshold may be based on a temperature or a range of temperatures which effects the temperature-sensitive characteristic of the treating chemistry in a desired manner. For example, the predetermined temperature threshold may be based on a temperature at which the treating chemistry exhibits a predetermined level of chemical reactivity. In another example, the predetermined temperature threshold may be based on a temperature below which an undesirable amount of foam formation occurs. The predetermined temperature threshold may be determined experimentally or based on empirical data for a specific treating chemistry and stored as a reference value or values in the memory 64 of the controller 14.

During the comparison at 104, the temperature determined at 102 may be compared to the stored reference value(s) for the treating chemistry that is to be dispensed. The identity of the treating chemistry to be dispensed may be determined manually by the user, such as through the user interface 16, or automatically based on sensor data capable of determining an identifying characteristic of the treating chemistry. The exact manner by which the identity of the treating chemistry is determined is not germane to the embodiments of the invention. In one example, the controller memory 64 may include a look-up table of reference values for specific treating chemistries which may be accessed by the controller 12 during the comparison at 104 to determine if the temperature of the liquid satisfies the predetermined threshold. In another example, the comparison at 104 may include providing the temperature of the liquid determined at 102 and the identifier of the treating chemistry to a software program algorithm that is configured to determine if the temperature satisfies the predetermined threshold based on the temperature and identifier input.

If it is determined at 104 that the temperature of the liquid does not satisfy the predetermined temperature threshold, then the controller 12 can control the dishwasher 10 to adjust the temperature of the liquid toward the predetermined temperature at 106. Adjusting the temperature may include raising or lowering the temperature of the liquid depending on the comparison made at 104. Raising the temperature of the liquid may include heating liquid collected in the sump 38 using the heating element 52 and/or adding water of a temperature greater than the temperature of the liquid in the treating chamber 20. During heating of the liquid collected in the sump 38 with the heating element 52, circulation of the liquid through the recirculation circuit may cease or may continue continuously or intermittently. Adding water of a temperature greater than the temperature of the liquid in the treating chamber 20 may include adding fresh water from a hot water supply through the water supply line 47.

In addition, at least a portion of the liquid can be drained from the sump 38 to decrease the volume of lower temperature liquid present in the treating chamber 20. Draining a portion of the liquid from the sump 38 may provide room in the treating chamber 20 for an additional supply of water and may also facilitate the rate at which the temperature of the liquid is increased by replacing at least a portion of the lower temperature liquid with higher temperature liquid and/or providing less liquid in the sump 38 to be heated by the heater 52.

Lowering the temperature of the liquid may include recirculating the liquid through the treating chamber 20 and the recirculation circuit without additional input of heat, such as by keeping the heating element 52 deactivated, adding water of a temperature less than the temperature of the liquid to the treating chamber 20, and/or pausing recirculation of the liquid through the recirculation circuit. Adding water of a temperature less than the temperature of the liquid in the treating chamber 20 may include adding cold or unheated water from a water supply through the water supply line 47. The pause in recirculation and the recirculation of water without activating the heating element 52 may facilitate heat transfer from the liquid through conduction to the tub 18, thus lowering the temperature of the liquid in the treating chamber 20.

In addition, at least a portion of the liquid can be drained from the sump 38 to decrease the volume of higher temperature liquid present in the treating chamber 20. Draining a portion of the liquid from the sump 38 may provide room in the treating chamber 20 for an additional supply of water and may also facilitate the rate at which the temperature of the liquid is decreased by replacing at least a portion of the higher temperature liquid with lower temperature liquid.

Elements 102, 104 and 106 of the method 100 can be repeated until the temperature of the liquid satisfies the predetermined temperature threshold at 104. If the temperature satisfies the predetermined temperature threshold, the treating chemistry can be dispensed at 108. In one example, liquid may be supplied to the dispenser 54 to flush the treating chemistry contained within the dispenser 54 into the treating chamber 20. In another example, dispensing the treating chemistry at 108 may include dispensing the treating chemistry into liquid as the liquid is supplied to the treating chamber 20, such as by dispensing the treating chemistry into liquid circulating through the recirculation circuit or liquid being supplied through the water supply line 47. In yet another example, the treating chemistry may be supplied to the liquid in the treating chamber 20, such as through a dispensing nozzle, for example. The exact manner by which the treating chemistry is dispensed may vary depending on the dispenser and liquid flow configuration of the dishwasher.

At 110, the temperature of the liquid in the treating chamber 20 may be maintained so as to satisfy the predetermined temperature threshold for a predetermined period of time. The predetermined period of time may be based on the temperature-sensitive treating chemistry, other treating chemistries, the selected cycle of operation, subsequent phases of the cycle of operation, desired phase or cycle length and/or based on a length of the currently executing phase of the cycle of operation. Maintaining the temperature to satisfy the predetermined temperature threshold at 110 may include determining the temperature of the liquid, determining if the temperature satisfies the threshold and adjusting the temperature of the liquid toward the threshold if the liquid does not satisfy the threshold in a manner similar to that described above at 102, 104 and 106, respectively.

The elements 102, 104, 106, 108 and 110 of the method 100 may be repeated multiple times during a cycle of operation for each temperature-sensitive chemistry that is to be dispensed. For example, a first treating chemistry having a first predetermined temperature threshold may be dispensed according to the method 100 during a cycle of operation and a second treating chemistry having a second predetermined temperature threshold may be dispensed according to the method 100 during the same cycle of operation.

Figure 4:
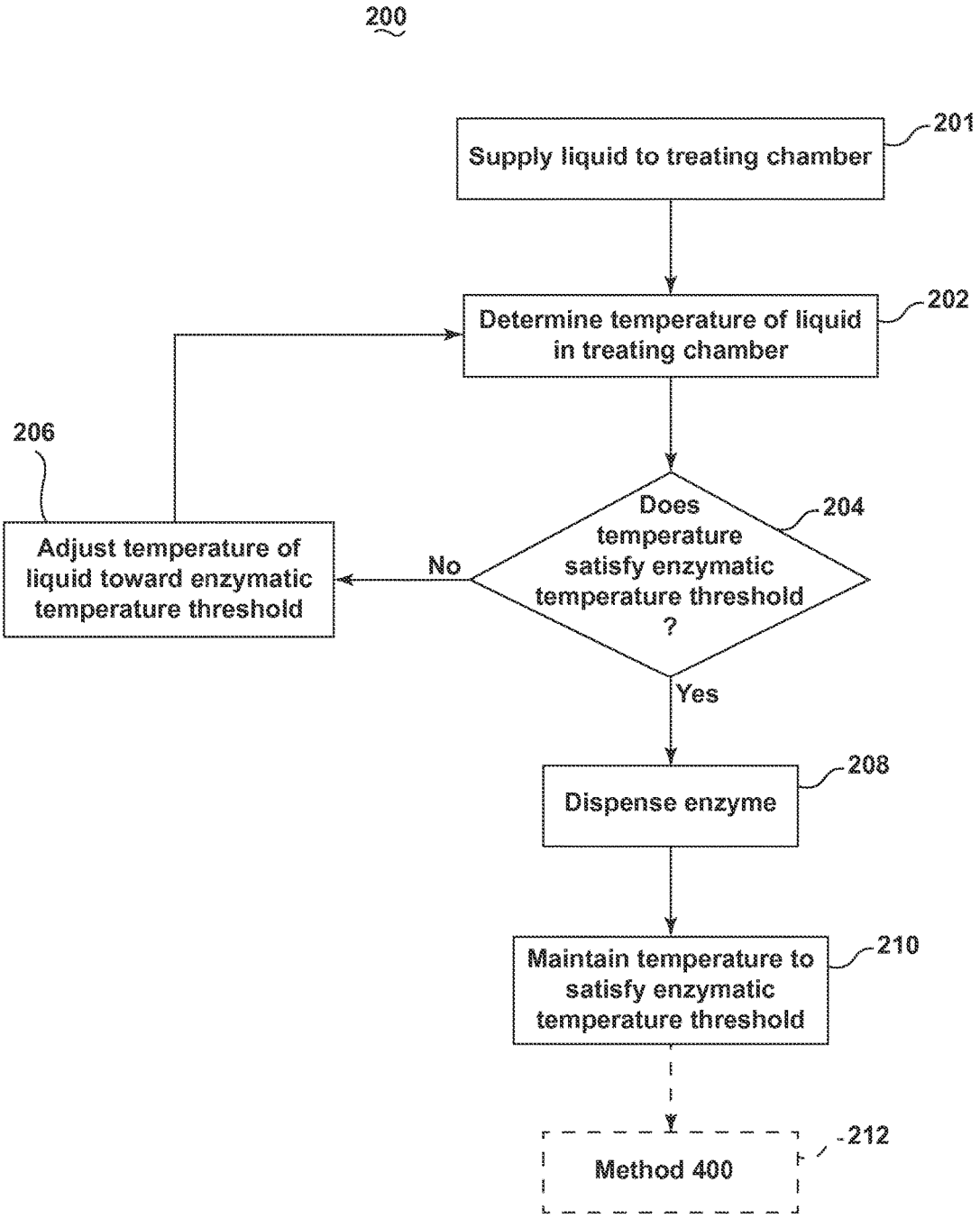
FIG. 4 is a flow chart illustrating a method of dispensing an enzyme during a cycle of operation according to an embodiment of the invention.

Referring now to FIG. 4, a method 200 for dispensing an exemplary treating chemistry in the form of an enzyme during a cycle of operation according to the method 100 of FIG. 3 is illustrated. The rate of reaction of an enzyme may be temperature sensitive and thus the method 200 may be used to dispense the enzyme at a predetermined liquid temperature and to maintain the temperature of the liquid so as to provide a predetermined level of enzyme activity during the cycle of operation. The method 200 is similar to the method 100 of FIG. 3 except that the method 200 is described in the context of an enzyme treating chemistry.

The method 200 begins with assuming that a user has loaded the dishwasher 10 with dishes to be treated, selected a desired cycle of operation which includes dispensing at least one enzyme during at least one phase of the selected cycle of operation, and provided the dispenser 54 with the at least one enzyme. Non-limiting exemplary types of enzymes suitable for use in treating dishes include enzymes which catalyze the breakdown of carbohydrates, such as amylases, enzymes that catalyze the breakdown of fats, such as lipases, and enzymes that catalyze the breakdown of peptide bonds (proteolysis), such as proteases. At a predetermined period of time following initiation of the selected cycle of operation, liquid may be supplied to the treating chamber 20 at 201 according to the selected cycle of operation.

At 202, the temperature of the liquid within the treating chamber 20 may be determined following initiation of the selected cycle of operation, as described above with respect to 102 of the method 100. The determined temperature of the liquid may be compared with a predetermined temperature threshold, in this case, an enzymatic temperature threshold at 204. The enzymatic temperature threshold may be based on the activity of the enzyme to be dispensed and may be set so as to dispense the enzyme when the temperature of the liquid is within a range of temperatures at which the enzyme provides a desired level of activity.

Figure 5:
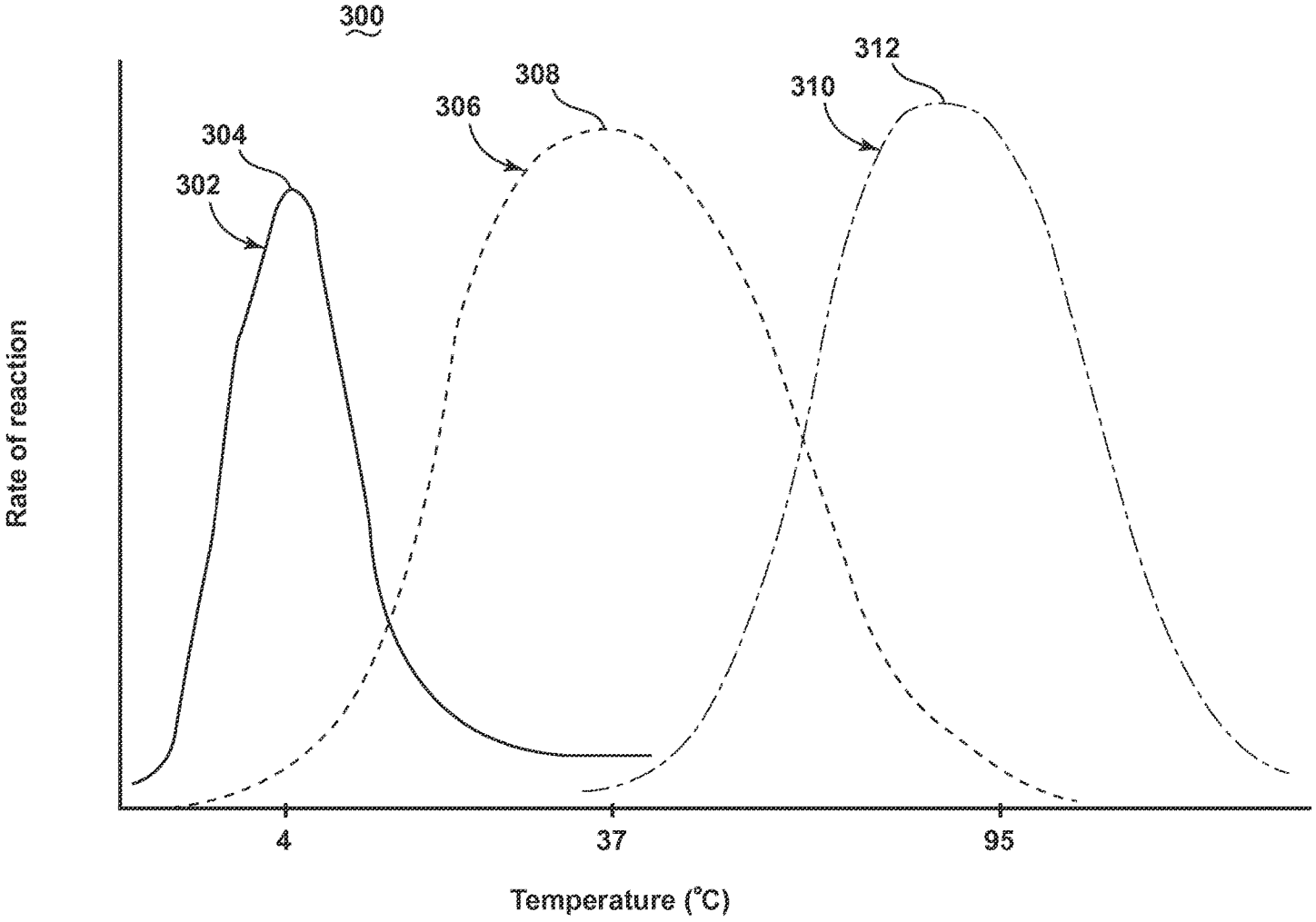
FIG. 5 is an exemplary chart illustrating reaction rate as a function of temperature for different enzymes.

Referring now to FIG. 5, an exemplary graph 300 showing a rate of reaction as a function of temperature for three different enzymes represented by curves 302, 306 and 310 is illustrated. The graph 300 is not indicative of real data, but is merely illustrative for the purposes of discussion. The rate of reaction is the concentration of enzyme substrate (i.e. the substance upon which the enzyme acts) disappearing or product produced per unit time (often described in units of moles per Liter per second (mol $L^{-1}s^{-1}$)). Both the shape of the curve and the maximum or peak of the curve can vary for each enzyme.

As can be seen with enzyme 306, as the temperature increases, the rate of reaction for the enzyme increases as well until a maximum rate of reaction is reached at 308. The temperature at which the enzyme exhibits its maximum reaction rate for a given set of conditions may be referred to as the peak enzyme activity temperature. As the temperature continues to increase past the peak enzyme activity temperature at 308, the rate of reaction begins to decrease as the continued increase in temperature begins to negatively effect the structure of the enzyme. Exposure of the enzyme to temperatures above the peak enzyme temperature 308 may lead to denaturing of the enzyme, thus decreasing the ability of the enzyme to effectively interact with the substrate, which slows the rate of reaction.

Still referring to FIG. 5, enzyme 302 has a peak enzyme activity temperature 304 corresponding to a temperature, in this example 4° C., at which the enzymes 306 and 310 exhibit minimal, if any, activity. As the temperature increases above the peak enzyme activity temperature 304 for enzyme 302, the rate of reaction for enzyme 306 increases, while the rate of reaction for enzyme 302 decreases. As the temperature continues to increase above the peak enzyme activity temperature 308 for enzyme 306, the rate of reaction for enzyme 306 decreases while the rate of reaction for enzyme 310 increases until a peak enzyme activity temperature 312 is reached for the enzyme 310.

FIG. 5 illustrates that temperature can both positively and negatively impact the rate of reaction of an enzyme. For a given enzyme, the maximum rate of reaction is exhibited at the peak enzyme activity temperature; however, enzyme activity may also be seen within a range of temperatures around the peak enzyme activity temperature. In addition, in a mixture of enzymes, such as a mixture of enzymes 302, 306 and 310, a temperature which may produce a desired level of enzyme activity for a first enzyme may produce minimal enzyme activity in a second enzyme and, if above the peak enzyme activity temperature for the second enzyme, may be detrimental to the enzyme.

Referring back to FIG. 4, the enzymatic temperature threshold at 204 may be based on the rate of reaction for the enzyme to be dispensed, and more specifically, may be based on the peak enzyme activity temperature for the enzyme to be dispensed. Satisfying the enzymatic temperature threshold may include the sensed temperature being above a low temperature limit, below a high temperature limit or within a predetermined temperature range. For example, a low temperature limit may be a temperature below the peak enzyme activity temperature but above which a desired level of enzyme activity may still occur. In another example, satisfying the enzymatic temperature threshold may include the temperature being within a predetermined temperature range above and below the peak enzyme activity temperature, such as +/−5° C. In yet another example, satisfying the enzymatic temperature threshold may include the temperature being within a predetermined temperature range below and up to the peak enzyme activity temperature.

If the temperature of the liquid determined at 202 does not satisfy the enzymatic temperature threshold, the temperature of the liquid may adjusted toward the enzymatic temperature threshold at 206 in a manner similar to that described above at 106 of the method 100. The elements 202, 204 and 206 may be repeated until the temperature of the liquid satisfies the enzymatic temperature threshold.

If the temperature of the liquid satisfies the enzymatic temperature threshold at 204, then the enzyme may be dispensed at 208. The enzyme may be dispensed to the treating chamber 20 and applied to the dishes held therein by dispensing the enzyme into the liquid as the liquid is supplied to the treating chamber 20, supplying the liquid to the dispenser 54 containing the enzyme, and/or supplying the enzyme to the liquid in the treating chamber 20, as described above at 108 of the method 100. At 210, the temperature of the liquid may be maintained to satisfy the enzymatic temperature threshold for a predetermined period of time based on the enzyme, in a manner similar to that described above at 110 of the method 100.

In the context of treating dishes in a dishwasher during a cycle of operation, enzymes are typically used to facilitate removal of soil, non-limiting examples of which include carbohydrates, fats, proteins, oils, or dyes, from the dishes. The rate of soil removal from the dishes, and thus the total amount of soil removed in a predetermined period of time, may be effected by several factors, including the amount of enzyme present and the activity of the enzyme. As the extent to which the temperature of the liquid in the treating chamber 20 is below the peak enzyme activity increases, the activity of the enzyme exhibits a concomitant decrease, thus decreasing the rate of enzyme-based soil removal from the dishes. While the enzyme may still exhibit activity at lower temperatures, the rate of reaction, and thus the rate of enzyme-based soil removal, will be lower. Thus, the dishes may require longer exposure time to the enzyme in order to remove the same amount of soil compared to when the enzyme is dispensed near the peak enzyme activity temperature, which may lead to longer cycle times.

If the enzyme is dispensed prior to satisfying the enzymatic temperature threshold, such as prior to or during an increase in the temperature of the liquid, by the time the temperature of the liquid satisfies the enzymatic temperature threshold, the amount of active enzyme remaining in the liquid may have decreased, thus decreasing the rate of soil removal, even once the temperature satisfies the enzymatic temperature threshold. The amount of active enzymes in the liquid may decrease over time as the enzymes are deactivated or destroyed by reaction with contaminants in the treating chamber 20 or become lost within the dishwasher system and not applied to the dishes.

The amount of time at which the temperature of the liquid is maintained at 210 may be based on the enzyme and additional factors, such as the desired length of the cycle of operation or phase or the presence of other treating chemistries. The closer the temperature of the liquid is to the peak enzyme activity temperature, the higher the level of enzyme activity and thus the higher the rate of enzyme-based soil removal. Thus, conditions which result in higher enzyme activity may correspond to shorter maintenance periods of the liquid temperature at the enzymatic temperature threshold. Conditions resulting in lower enzyme activity may correspond with longer maintenance periods to provide the same level of enzyme-based soil removal as provided by higher enzyme activity conditions.

In addition, as the length of time the temperature is maintained to satisfy the enzymatic temperature threshold increases, the overall length of the cycle of operation may also increase. In addition, over time the activity of the enzyme, and thus the rate of soil removal, may start to decrease, such as may occur as the amount of active enzyme decreases. The enzymatic temperature threshold may not be suitable for other treating chemistries within the liquid and thus maintaining the temperature for purposes of enzyme activity may also need to be balanced with maintaining the effectiveness of other treating chemistries used during the cycle of operation.

Thus, the enzymatic temperature threshold for a given enzyme and the period of time at which the temperature of the liquid is maintained to satisfy the threshold may be set to provide a predetermined rate of soil removal within a predetermined period of time, thus increasing the efficiency with which the enzyme is used during the cycle of operation. Increasing the efficiency of the enzyme may decrease the cost of the treating chemistry, as fewer enzymes may be used while still providing the same or greater rate of enzyme-based soil removal. Additionally, or alternatively, increasing the efficiency of the enzyme may also decrease the length of the cycle of operation, such as by providing an increase in the rate of soil enzyme-based removal and thus requiring less cycle time to obtain the same or greater degree of soil removal.

The method 200 may be repeated multiple times to dispense enzymes having different enzymatic temperature thresholds, such as during multi-stage chemistry dispensing. For example, referring again to FIG. 5, the temperature of the liquid may be adjusted to sequentially dispense each enzyme 302, 306 and 310 based on the peak enzyme activity temperature for each enzyme. The temperature may be maintained after the dispensing of each enzyme 302, 306 and 310 so as to provide an overall desired rate of soil removal and cycle length for the cycle of operation.

Figure 6:
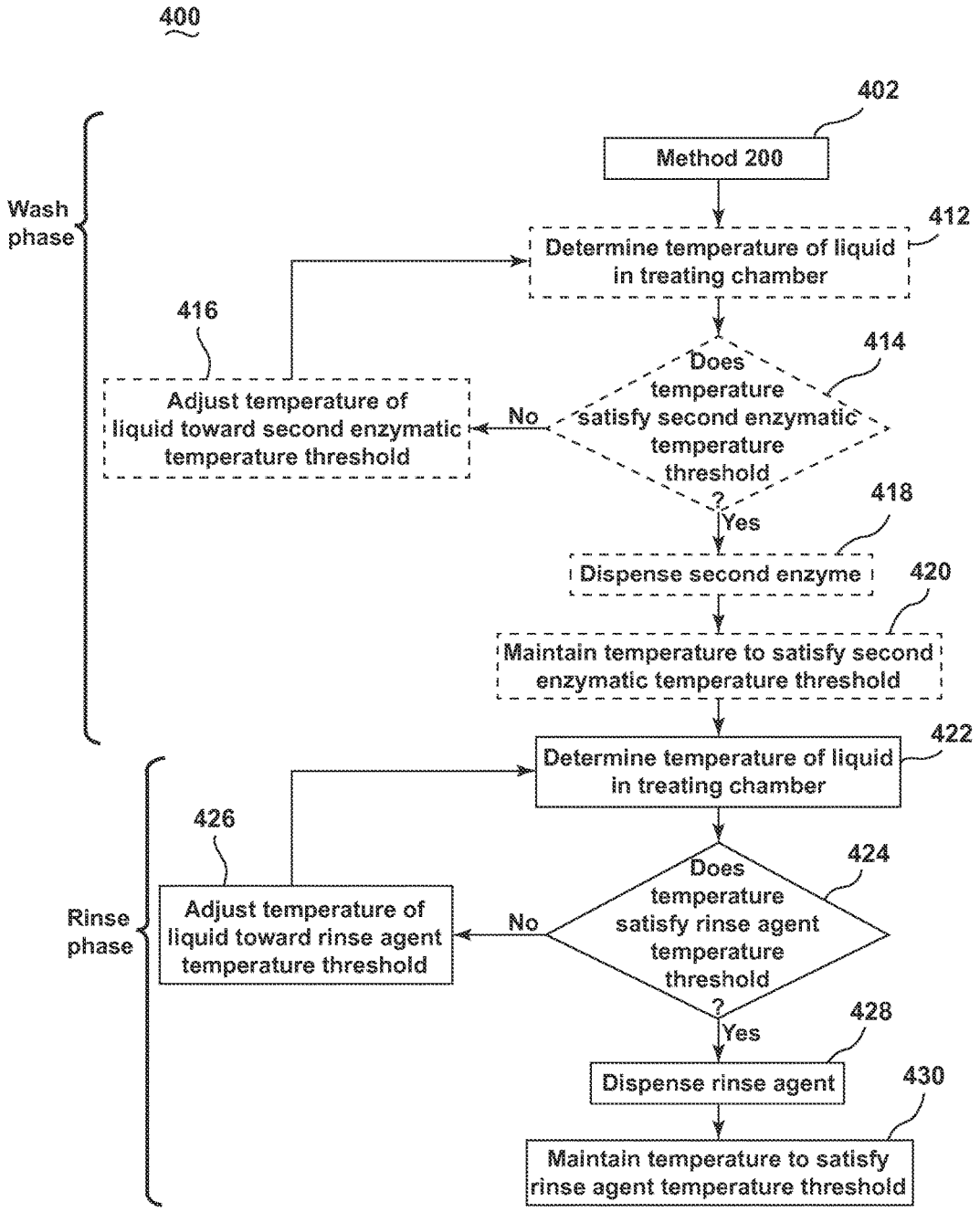
FIG. 6 is a flow chart illustrating a method of dispensing a treating chemistry during a cycle of operation according to an embodiment of the invention.

FIG. 6 illustrates a method 400 which may be optionally combined with the method 200 of FIG. 4 to dispense multiple treating chemistries during a cycle of operation according to the method 100 of FIG. 3. The method 400 may be used to dispense one or more enzymes during a wash phase of a cycle of operation and a rinse agent during a rinse phase of the cycle of operation.

As illustrated in FIG. 6, at 402 the method 200 may be used to dispense a first enzyme as described above with respect to FIG. 4. Optionally, a second enzyme, different than the first, may be dispensed in a manner similar to that of the first enzyme at elements 412 through 420. At 414, the temperature threshold is a second enzymatic temperature threshold based on the second enzyme and the period of time that the temperature of the liquid is maintained to satisfy the second enzymatic temperature threshold at 420 is based on the second enzyme. The elements 412 through 420 may be repeated multiple times for each enzyme or other temperature-sensitive treating chemistry to be dispensed, with the temperature threshold and period of time to maintain the temperature to satisfy the temperature threshold being based on each temperature-sensitive treating chemistry.

The dispensing of the first enzyme and the second enzyme may be part of a wash phase of cycle of operation. In one example, the first enzyme may be dispensed at 402 as part of a pre-wash phase and the second enzyme may be dispensed at 418 as part of a main wash phase. The method 400 may continue following the dispensing of the first enzyme or optionally following the dispensing of the second enzyme at 422 with determining the temperature of the liquid at 422 and determining whether the temperature of the liquid satisfies a rinse agent temperature threshold at 424. If the temperature of the liquid does not satisfy the rinse agent temperature threshold, the temperature of the liquid may be adjusted at 426 and the elements 422, 424 and 426 may be repeated until the temperature of the liquid satisfies the rinse agent temperature threshold. If the temperature satisfies the rinse agent temperature threshold, at 428 the rinse agent may be dispensed and the temperature may be maintained to satisfy the rinse agent temperature threshold at 430 for a predetermined period of time, in a manner similar to that described above for elements 102 through 110 of the method 100 of FIG. 3.

A rinse agent, which typically includes one or more surfactants, may be released during a rinse phase of the cycle of operation to facilitate drying of the dishes. For some surfactants, if the rinse agent is released when the temperature of the liquid is below a predetermined value, the rinse agent may form an undesirable foam during circulation of the liquid and rinse agent through the treating chamber 20. Satisfying the rinse agent temperature threshold may include the sensed temperature being above a low temperature limit, below a high temperature limit or within a predetermined temperature range. For example, a low temperature limit may be a temperature below which the rinse agent foams and thus the rinse agent is dispensed only when the temperature is above the low temperature limit. In another example, satisfying the rinse agent temperature threshold may include the temperature being within a predetermined temperature range above the temperature at which an undesirable amount of foaming occurs.

In a typical cycle, the rinse agent is dispensed at a predetermined time during the cycle of operation. However, if the temperature of the liquid in the treating chamber is too low at that predetermined time in the cycle, such as may occur if the incoming water from the water supply is cooler than expected or there are fewer dishes in the treating chamber than expected, an undesirable foaming condition may occur. The method 400 may be used to minimize an undesirable foaming condition by dispensing the rinse agent based on the temperature of the liquid and then maintaining the temperature to continue to minimize the likelihood of rinse agent foaming.

The period of time at which the temperature is maintained to satisfy the rinse agent temperature threshold at 430 may be based on the rinse agent and may correspond to a length of time that the rinse agent is present in the treating chamber 20 or may correspond to the end of the rinse phase. In one example, the temperature may be maintained to satisfy the rinse agent temperature threshold until the rinse agent is rinsed from the dishes and drained away. In another example, the temperature may be maintained until liquid is no longer being circulated through the treating chamber 20, such as at the end of the rinse phase, for example.

The methods described herein may be used to dispense a treating chemistry having a temperature-sensitive characteristic based on a temperature of the liquid in the dishwasher and further to maintain the temperature of the liquid based on the temperature-sensitive characteristic of the treating chemistry to increase the efficiency of the treating chemistry. In addition, the methods described herein may further be used to avoid an undesirable condition that may occur based on the temperature-sensitive characteristic of the treating chemistry.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for treating dishes in a dishwasher having a treating chamber for receiving the dishes for treatment according to an automatic cycle of operation, the method comprising:

supplying liquid to the treating chamber;

sensing a temperature of the liquid;

comparing the sensed temperature of the liquid to an enzymatic temperature threshold;

adjusting the temperature of the liquid toward the enzymatic temperature threshold when the comparing indicates the sensed temperature does not satisfy the enzymatic temperature threshold;

an initial dispensing of an enzyme into the liquid when the comparing indicates the sensed temperature satisfies the enzymatic temperature threshold; and maintaining the temperature of the liquid to satisfy the enzymatic temperature threshold.

2. The method of claim 1 wherein satisfying the enzymatic temperature threshold comprises one of the sensed temperature being above a low temperature limit, below a high temperature limit, or within a predetermined temperature range.

3. The method of claim 1 wherein adjusting the temperature of the liquid comprises at least one of raising the temperature of the liquid or lowering the temperature of the liquid.

4. The method of claim 1 wherein the initial dispensing of the enzyme comprises one of dispensing the enzyme into the liquid as the liquid is supplied to the treating chamber, supplying the liquid to a dispenser containing the enzyme, or supplying the enzyme to the liquid in the treating chamber.

5. The method of claim 1, further comprising dispensing a second enzyme into the liquid.

6. The method of claim 1 wherein the initial dispensing of the enzyme comprises dispensing at least one enzyme during a wash phase of the cycle of operation.

7. The method of claim 1 wherein the temperature of the liquid is maintained to satisfy the enzymatic temperature threshold for a predetermined amount of time based on the enzyme dispensed into the liquid.

8. The method of claim 3 wherein raising the temperature of the liquid comprises at least one of heating the liquid with a heating element in fluid contact with at least a portion of the liquid or adding water of a temperature greater than the temperature of the liquid to the treating chamber.

9. The method of claim 3 wherein lowering the temperature of the liquid comprises at least one of recirculating the liquid through the treating chamber without additional input of heat, adding water of a temperature less than the temperature of the liquid to the treating chamber, or pausing a recirculation of the liquid.

10. The method of claim 6, further comprising an initial dispensing of a first enzyme into the liquid when the comparing indicates the sensed temperature satisfies a first enzymatic temperature threshold and an initial dispensing of a second enzyme into the liquid when the comparing indicates the sensed temperature satisfies a second enzymatic temperature threshold and maintaining the temperature of the liquid to satisfy the first and second enzymatic temperature thresholds, respectively.

11. The method of claim 8, further comprising draining at least a portion of the liquid from the treating chamber.

12. The method of claim 9, further comprising draining at least a portion of the liquid from the treating chamber.

13. The method of claim 6, further comprising comparing the sensed temperature of the liquid to a rinse agent temperature threshold during a rinse phase of the cycle of operation and dispensing a rinse agent when the comparing indicates the sensed temperature satisfies the rinse agent temperature threshold.

14. A method for treating dishes in a dishwasher having a treating chamber for receiving the dishes for treatment according to an automatic cycle of operation, the method consisting essentially of:

supplying liquid to the treating chamber;

sensing a temperature of the liquid;

comparing the sensed temperature of the liquid to an enzymatic temperature threshold;

adjusting the temperature of the liquid toward the enzymatic temperature threshold when the comparing indicates the sensed temperature does not satisfy the enzymatic temperature threshold;

an initial dispensing of an enzyme into the liquid when the comparing indicates the sensed temperature satisfies the enzymatic temperature threshold; and maintaining the temperature of the liquid to satisfy the enzymatic temperature threshold.

* * * * *